United States Patent [19]

Beccaria et al.

[11] Patent Number: 4,962,888

[45] Date of Patent: Oct. 16, 1990

[54] PORTABLE DEVICE FOR THE STORAGE OF WATER UNDER PRESSURE SUPPLIED, WHEN DRAWN, AS A BROKEN FORCED JET

[76] Inventors: Giuseppe Beccaria, Via dei Giuochi Istmici 7, Roma; Enzo Fava, Via Valdice 7; Giuseppe Manfredini, Via A. Bravi 26, both of Recanati (MC), all of Italy

[21] Appl. No.: 301,548

[22] Filed: Jan. 26, 1989

[30] Foreign Application Priority Data

Dec. 29, 1988 [IT] Italy ..... 602/88[U]

[51] Int. Cl.[5] ..... B05B 9/047; B05B 15/08

[52] U.S. Cl. ..... 239/152; 239/197; 239/198; 239/273; 239/281; 239/323; 239/375; 222/174; 141/18; 141/382; 141/387

[58] Field of Search ..... 239/152, 197–198, 239/273, 280–281, 327, 320–323, 375; 248/287, 359 E; 16/115; 222/174, 180; 141/18, 382, 383, 387

[56] References Cited

U.S. PATENT DOCUMENTS

| | | | |
|---|---|---|---|
| 902,863 | 11/1908 | Darrow | 239/280 X |
| 3,674,062 | 7/1972 | Ellers et al. | 141/387 |
| 3,878,896 | 4/1975 | White et al. | 239/198 X |
| 4,135,559 | 1/1979 | Barnby | 141/18 |

FOREIGN PATENT DOCUMENTS

| | | | |
|---|---|---|---|
| 235441 | 1/1964 | Austria | 239/323 |
| 2230148 | 7/1978 | Fed. Rep. of Germany | 239/532 |
| 134976 | 2/1880 | France | 239/198 |

*Primary Examiner*—Andres Kashnikow
*Assistant Examiner*—William Grant
*Attorney, Agent, or Firm*—Leonard Bloom

[57] ABSTRACT

A portable device for the storage of water under pressure fitted with a hose ending with a nozzle which may be used either to introduce the water under pressure in the storage tank or to activate the supply of a jet from the same.

12 Claims, 2 Drawing Sheets

PORTABLE DEVICE FOR THE STORAGE OF WATER UNDER PRESSURE SUPPLIED, WHEN DRAWN, AS A BROKEN FORCED JET

BACKGROUND AND SUMMARY

This application for an industrial patent concerns a portable device for the storage of water under pressure fitted with a hose ending with a nozzle in which the hose may be used either to introduce the water under pressure in the storage tank or to activate the supply of a jet of water from the storage tank. The tank filling and drawing operations of the stored water may be carried out by means of a single pipe (hose), fixed at one end to the storage tank and ending at the other end with a particular nozzle having a new and specific design. The nozzle is fitted with a ring nut which allows fast and secure locking to the tap from which the water under pressure is drawn.

A stop valve is fitted inside this nozzle which must obviously be opened during the tank filling phase and closed once the filling operation has been completed. When the device in question needs to be used, the same stop valve is used, opening it, obviously, to supply a forced and broken jet of water from the above nozzle.

Another advantage of the device in question concerns the fact that the air under pressure is supplied directly into the tank, while the water is stored in a bag made of an elastic water-proof membrane.

This feature was used in order to prevent the sides of the tank, which for economical reasons are made of a metallic material, from gradually and inevitably rusting in time. On one hand, the rusting would pollute the water gradually stored and supplied, and on the other would create cracks which make the device totally useless.

Another, not less important feature of the device in question is an articulated handle consisting of a set of telescopic rods which can be extended vertically when used so as to have an upright shaft at the top of which the nozzle supplying the jet of broken water may be hooked. In this regard it must be noted that the pipe (hose) for filling and draining the tank is wound around a pulley fitted in a box fixed outside one of the two bottoms of the tank. In the current version of the device, the box to store the hose is not erect in a vertical position but is loaded with its longitudinal axis in a horizontal position.

The above pipe (hose) is wound automatically on the relative winding pulley since the pulley is constantly subject to the rewinding return force of a spiral spring which is also fitted appropriately in the above box.

This and other innovative features of this invention will become clearer as the description proceeds, with reference to the enclosed drawings which are used descriptively rather than in a limiting sense and in which:

BRIEF DESCRIPTION OF THE PREFERRED EMBODIMENTS

Figure 2:
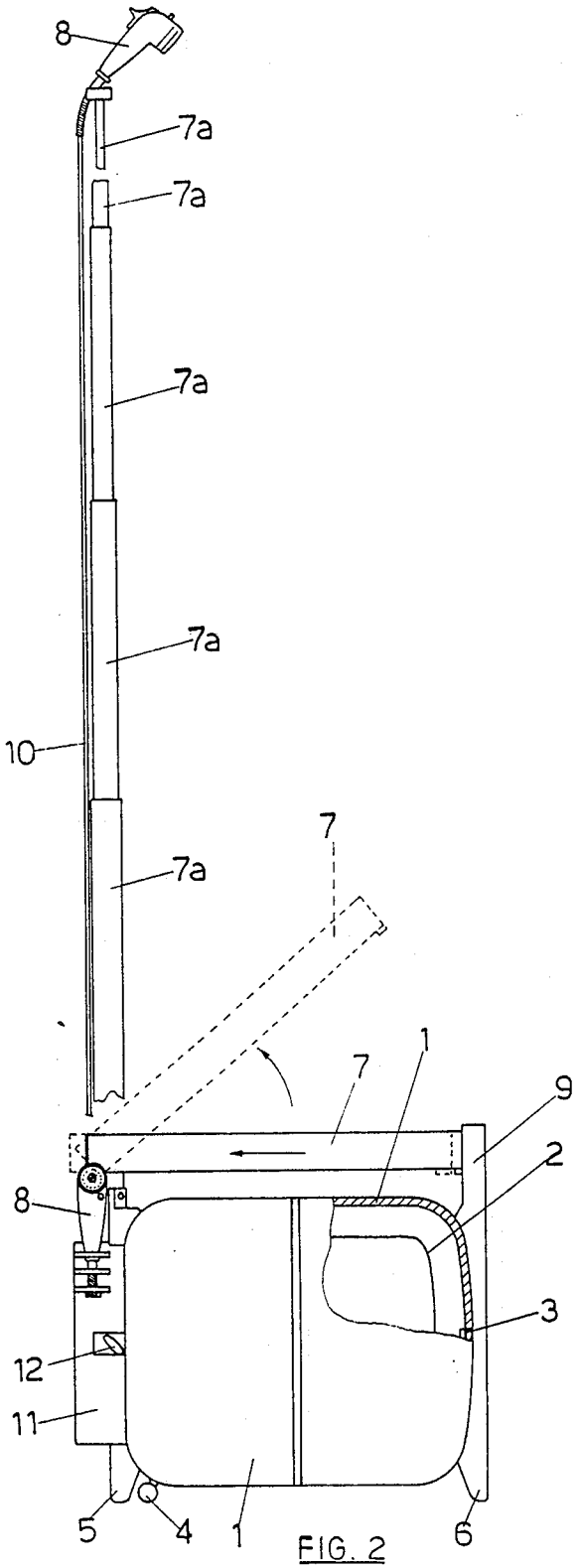
FIG. 2 is a schematic representation of the device in question, side view, with the handle rotated and the set of telescopic rods of the hanle extended to support the supply nozzle.
Figure 1:
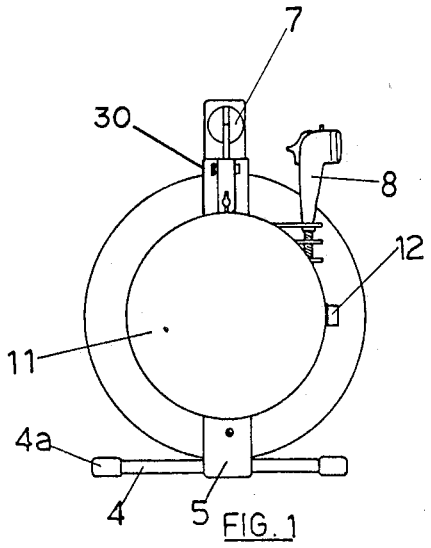
FIG. 1 is a schematic representation of the device according to the invention, front view at rest.

With reference to the above figures the model according to the invention includes a metal tank (1), cylindrical in shape with a horizontal longitudinal axis, in which a bag (2) made of elastic water-proof membrane is fitted into which the water is stored. Air under pressure is present and acts outside this storage bag (2), the air being introduced between the bag (2) and the tank (1). The air is introduced in the tank (1) through an appropriate valve (3) fitted on the back bottom of the tank.

When placed on the ground the tank is balanced thanks to an anti-tipping stabilizing and support structure consisting of a front cross-piece (4), fitted with rebber end couplings (**4*a*) and of two feet (5 and 6) axially opposed and situated on the plane of vertical symmetry of the tank (1**).

The tank (1) can be transported easily be gripping the handle (7). The handle consists of a tubular rod which extends longitudinally, and at the centre, above the tank (1), and is of approximately the same length as the tank.

More precisely this rod (7) pivots at the front end on a projection from the tank (30) so that, at the time requeired, the rod (7) can be rotated upwards to a vertical position. When in a vertical position the telescopic rods (**7*a*) in this handle (7) can be extended and the handle is transformed into a thin upright column at the top of which the supply nozzle (8) is hooked, as illustrated in FIG. 2**.

In order to eliminate the risk of unwanted and dangerous lifting of the handle (7) during transport, when at rest, the back end section of the latter is fitted into a groove on an upright bracket (9) fixed on the outside to the back bottom of the tank (1).

Therefore, as shown in FIG. 2, when it is necessary to tip the handle (7) upwards, the handle itself must first be moved forward to slide the back end of the handle from the housing groove on the bracket (9). The handle (7) may then and only then, be pivoted upwardly about the projection from the tank (30). As a further safety precaution, a ratchet is fitted, which is subject constantly to the action of a return spring which prevents the rod from moving forward freely and which can therefore be moved only after this ratchet has been unhooked by hand.

The design of the safety device in question is conventional and it has therefore not been included in the enclosed drawings. Neither has the pulley for the hose (10) through which the water under pressure may be loaded into the tank (1) or drawn from the same, been included, since the pulley is of conventional design.

This pulley is closed in the box (11). It is positioned outside the front bottom of the tank and is constantly subject to the return action of a spiral spring which ensures that the hose (10) is rewound automatically, and which is prevented from rewinding when the device is used, by a ratchet (12) which interferes with the geared profile of a ratchet gear which rotates integrally with the above pulley. The pulley and means for winding the hose (10) are known to persons skilled in the art.

One end of the hose (10) is connected to an appropriate conventional coupling through which it cmmunicates to the internal chamber of the storage bag (2). This type of coupling is knpwn to persons skilled in the art.

Figure 3:
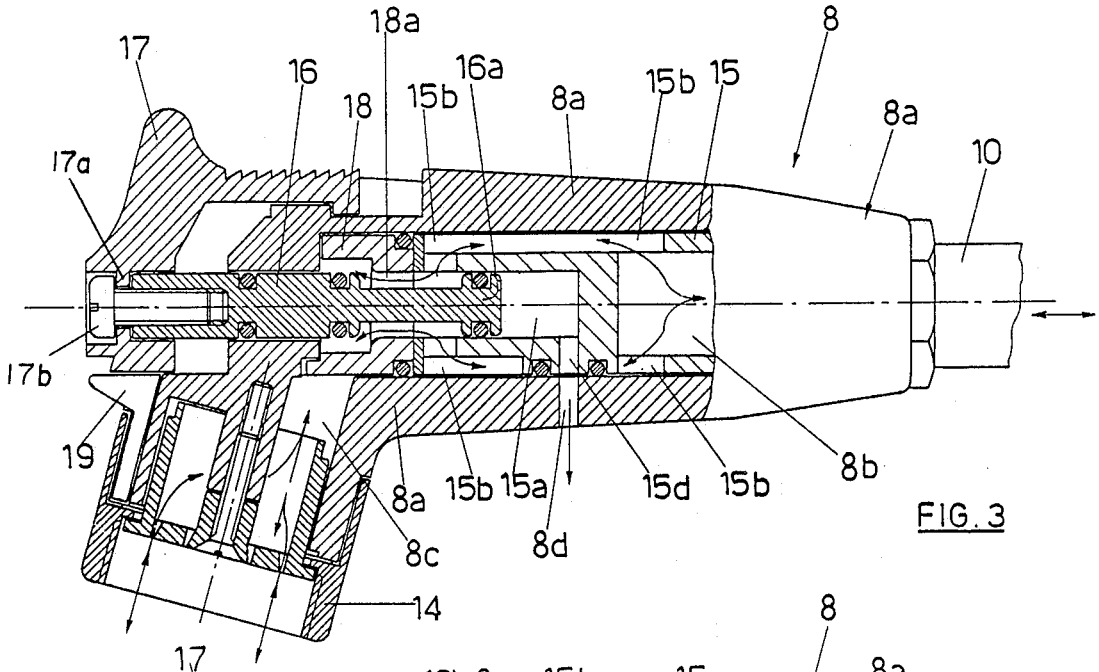
FIG. 3 and 4 illustrate two identical sections of the supply nozzle which show the position of the stop valve which operates in the nozzle, the valves shown in an open and in a closed position respectively.
Figure 4:
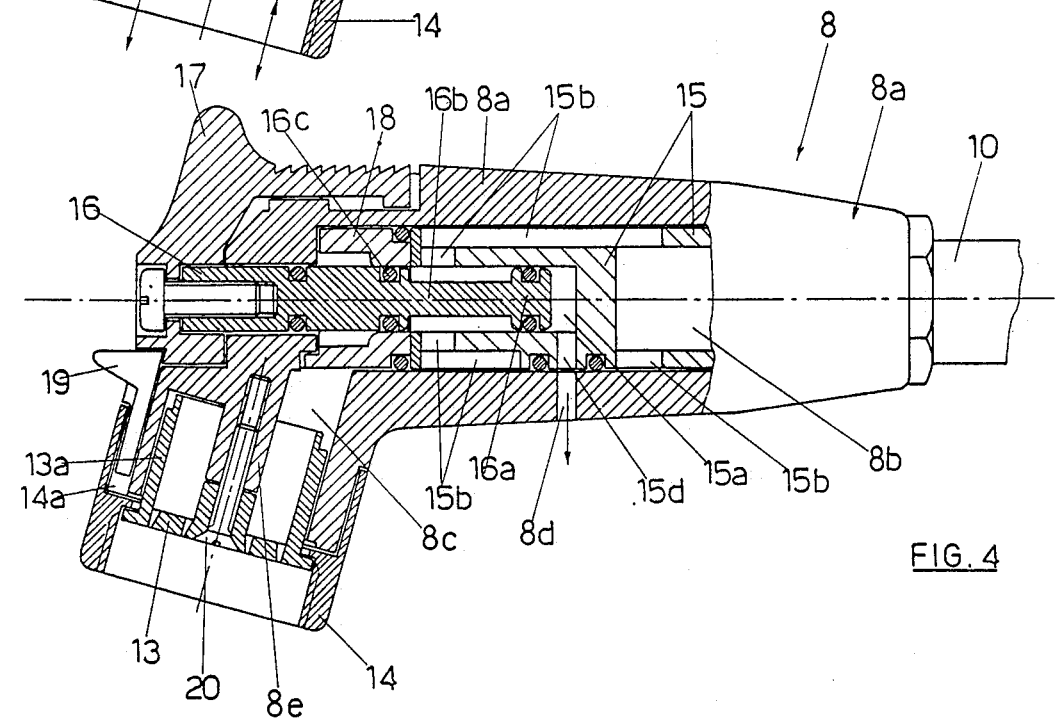

The above nozzle (8) is connected to the other end of the hose. Two way flows can be obtained through hose, one incoming flow to fill the tank and one outgoing flow when the water previously stored is used. As illustrated in FIG. 3 and 4, the above nozzle (8) includes a hollow body (8*a*) which is crossed by a rectilinear pipe (8*b*) which ends and connects at the front with a transverse pipe (8*c*). At the external outlet of the pipe, both the perforated plate (13), which breaks the forced jet of outgoing water, and the ring nut (14) used for fixing the nozzle (8) to the supply water tap, are fitted.

A slotted cylindrical unit (15) is housed perfectly in the rectilinear pipe (8*b*) and the former has a circular housing (15*a*) cut along the axis in which the plunger (16*a*) made at the end of a stopper shaft (16) fits tightly, and at the other end of which, extending from the front of the hollow body (8*a*) a silding knob (17) is screwed. The sliding knob (17) has an internal annualr flange (17*a*), or nib, thereon which is connected to the shaft (16) by the screw (17*b*) through which the above shaft (16) may be moved forwards or backwards.

The axial pipe (8*b*) communicates with the transverse pipe (8*c*) through the above slotted cylindrical body (15) and through a collar (18) opposite and coaxial to the unit (15) and fitted with a circular passageway section (18*a*). The diameter of the circular passageway section (18*a*) is the same as that of the stopper shaft (16) into which it is fitted, the stopper shaft (16) has an intermediate section of a smaller diameter (16*b*) ending with the above plunger (16*a*).

The nozzle (8) opening is obtained by extracting the stopper shaft (16) from the front of the hollow body (8*a*) to the end, with the knob (17), as illustrated in FIG. 3. In this case, the section with smaller diameter (16*b*) of the stopper shaft (16) crosses the passageway section (18*a*) of the collar (18) so that the water can pass freely from pipe (8*b*) to pipe (8*c*) and vice-versa through the slots of the collar (18) and through the longitudinal slots (15*b*) of the body of (15).

To close the nozzle (8) on the other hand, again using the knob (17), the stopper shaft (16) is inserted to the end of the hollow body (8*a*) so that the section of the shaft (16) with the larger diameter crosses the passageway section (18*a*) of the collar, to provide an airtight closing.

In this regard, attention is drawn to the radial and coaxial holes (15*d*) and (8*d*) which are on the slotted body (15) and the hollow body (8*a*) respectively in order to allow air in the housing (15*a*) of the body (15) to flow out freely. Otherwise, under the pressure of the plunger (16*a*), when the shaft (16) translates, the shaft would be stopped from moving forward, and would practically push the shaft back from the closed position reached at the end of the forward stroke. In this regard, attention is drawn to the fact that the shaft (16) ends with a plunger (16*a*) in order to make the closed position of the shaft (16) stable. Otherwise the shaft would be subject to an hydraulic thrust tending to push it out of the hollow body (8*a*) with consequent unwanted supply of a forced jet of water from the tank.

By fitting the plunger (16*a*), when the nozzle is closed, the above hydrostatic thrust is balanced, duly counterbalanced by an identical thrust in the opposite direction on the above plunger (16*a*).

The stable stop of the stopper shaft (16*a*) in a closed position is guaranteed by a safety tab (19). The safety tab (19) has a nib housed and sliding in an appropriate groove (14*a*) cut outside the transverse cylindrical projection of the hollow body (8*a*) which circumscribes the transverse pipe (8*c*). The ring nut (14) is fitted loosely outside this projection and is held into place by means of respective shouldered flanges, by the bowl (13*a*) with perforated bottom plate (13), fixed by means of an axial screw (20) to a centre rod (8*e*) at the centre of the pipe (8*c*).

Finally, attention is drawn to the fact that a conventional valve, normally found on the market, may be positioned at the outlet of the nozzle (8), to adjust the flow of the water supplied, so as to make it more or less constant despite the gradual reduction of the water pressure in the tank.

We claim:

1. A portable device for the storage of water under pressure which is supplied when drawn as a broken forced jet, comprising a cylindrical tank in which a storage bag made of an elastic water-proof membrane is fitted, the water being stored in the bag, compressed air being forced through a valve positioned on the tank such that the compressed air may be introduced between the tank and the bag, a hose having a first end connected to the storage bag, the hose having a second end having a nozzle connected thereto such that the water under pressure may be loaded in the tank through the nozzle and water from the tank may be drawn from the same nozzle; the tank being fitted with a handle consisting of a tubular rod extending longitudinally and centrally over the tank, the handle further having a plurality of telescopic rods fitted therein, the handle having a front end portion pivotally mounted to the tank, so that the tubular rod may be rotated upwards to a vertical position to permit extraction of the telescopic rods fitted in the handle.

2. A portable device for the storage of water under pressure which is supplied when drawn as a broken, forced jet according to claim 1, further comprising the tank having a plane of vertical symmetry; an anti-tipping stabilizing and support structure consisting of a front cross-piece attached to the tank, and two feet attached to the tank, the feet being placed axially opposite one another and on the plane of vertical symmetry of the tank.

3. A portable device for the storage of water under pressure which is supplied when drawn as a broken, forced jet according to claim 1, characterized in that the nozzle is fitted with a ring nut which makes it possible to fix the same to a water supply tap under the tank.

4. A portable device for the storage of water under pressure which is supplied when drawn as a broken forced jet, comprising a cylindrical tank in which a storage bag made of an elastic water-proof membrane is fitted, the water being stored in the bag, compressed air being forced through a valve positioned on the tank, such that compressed air may be introduced between the tank and the bag, a hose having a first end connected to the storage bag, the hose having a second end having a nozzle connected thereto such that the water under pressure may be loaded in the tank through the nozzle and water from the tank may be drawn from the nozzle; the nozzle having a substantially cylindrical hollow body, an axial pipe extending longitudinally in the hollow body, the axial pipe being connected to a transverse pipe; the transverse pipe communicating with the axial pipe through a collar, the collar having a passageway section, the passageway section having a diameter, a stopper shaft having a diameter substantially equal to the diameter of the passageway section, the stopper shaft being fitted into the passageway section, the stopper shaft having a front end and a back end, the back end having a plunger thereon, the plunger fitted for sliding movement in an axial cavity of a slotted cylindrical body, the cylindrical body being fitted into the axial pipe to contact the collar such that the stopper shaft may be translated axially within the collar by means of a knob, the knob having an internal annular flange screwed to the front end of said stopper shaft, the end extending axially from the axial pipe.

5. A portable device for the storage of water under pressure which is supplied when drawn, as a broken forced jet according to the claim 4, wherein when the nozzle is in a closed position, the stable stop of the stopper shaft is guaranteed by a safety tab with a nib, the nib being housed and slidably movable in a special groove formed in the transverse pipe.

6. A portable device for the storage of water under pressure which is supplied when drawn as a broken forced jet, comprising a cylindrical tank in which a storage bag of an elastic water-proof membrane is fitted, the water being stored in the bag, compressed air being forced through a valve positioned on the tank such that the compressed air may be introduced between the tank and the bag, a hose having a first end connected to the storage bag, the hose having a second end having a nozzle connected thereto such that the water under pressure may be loaded in the tank through the nozzle and water from the tank may be drawn from the nozzle; the nozzle having a ring nut thereon for connection to a water supply tap a rod carried by the device and having an end extending upwardly therefrom, the rod being telescoped, such that the end of the rod may be adjusted to a desired height above the device, and means for mounting the nozzle on the end of the rod.

7. A portable device for storage of water under pressure comprising in combination: a tank, means for introducing the water into the tank, means for pumping the water out of the tank, a handle having a front end pivotally mounted on the tank, the handle extending longitudinally across the tank, the handle further having a plurality of sections telescopically connected to one another such that the handle may be pivoted about the front end to extend vertically upwardly from the tank to a desired height, a hose having a first end connected to the tank so that the water threin may enter the hose, the hose having a second end having a nozzle thereon for dispensing the water, the hose being supported by and carried on the telescoping handle and the nozzle being attached to the telescoping handle such that the nozzle may be positioned at a desired height above the tank.

8. The combination of claim 7, wherein the means for pumping the water out of the tank is compressed air.

9. The combination of claim 8, wherein the tank has a valve therein by which the compressed air may be introduced into the tank.

10. The combination of claim 7, wherein a storage bag made of an elastic water-proof membrane to contain the water is fitted in the tank, the storage bag being connected to the first end of the hose.

11. The combination of claim 7, wherein the hose may be used for introducing the water into the tank and for emptying the water from the tank.

12. The combination of claim 7, wherein the nozzle includes a substantially cylindrical hollow body, an axial pipe extending longitudinally in the hollow body, the axial pipe being connected to a transverse pipe; the transverse pipe communicating with the axial pipe through a collar, the collar having a passageway section, the passageway section having a diameter, a stopper shaft having a diameter substantially equal to the diameter of the passageway section, the stopper shaft being fitted into the passgeway section, the stopper shaft having a front end and a back end, the back end having a plunger thereon, the plunger being fitted for sliding movement in an axial cavity of a slotted cylindrical body, the cylindrical body being fitted into the axial pipe to contact the collar such that the stopper shaft may be translated axially within the collar by means of a knob, the knob having an internal annular flange screwed to the front end of said stopper shaft, the end extending axially from the axial pipe.

* * * * *